US006513692B1

(12) United States Patent
Forgosh et al.

(10) Patent No.: US 6,513,692 B1
(45) Date of Patent: Feb. 4, 2003

(54) ROLL CARRIER

(75) Inventors: Lee Forgosh, Manchester, NH (US); Joanne Taube, Bedford, NH (US)

(73) Assignee: Tranzporter International LLC, Manchester, NH (US)

( * ) Notice: Subject to any disclaimer, the term of this patent is extended or adjusted under 35 U.S.C. 154(b) by 56 days.

(21) Appl. No.: 09/801,982

(22) Filed: Mar. 8, 2001

Related U.S. Application Data

(60) Provisional application No. 60/187,650, filed on Mar. 8, 2000.

(51) Int. Cl.[7] ..... A45C 15/00

(52) U.S. Cl. ..... 224/575; 224/605; 224/617; 224/237; 224/251; 224/901.4; 224/901.6

(58) Field of Search ..... 224/605, 607, 224/612, 613, 616, 617, 622, 237, 236, 250, 251, 581, 575, 901.4, 901.6

(56) References Cited

U.S. PATENT DOCUMENTS 2,502,033 A * 3/1950 Bohn ..... 206/278
4,097,944 A * 7/1978 Yulish ..... 5/419
4,423,834 A * 1/1984 Rush ..... 190/901
4,679,242 A * 7/1987 Brockhaus ..... 190/1
4,967,986 A * 11/1990 Schildkraut ..... 224/223
5,287,571 A * 2/1994 Rademacher ..... 190/2
5,327,669 A * 7/1994 Lannan et al. ..... 206/315.11
D366,958 S * 2/1996 Harr ..... D3/259
6,061,849 A * 5/2000 Seals ..... 383/4
6,065,659 A * 5/2000 Faz ..... 206/570

* cited by examiner

*Primary Examiner*—Stephen K. Cronin
(74) *Attorney, Agent, or Firm*—Maine & Asmus

(57) ABSTRACT

The invention in the simplest form is an adjustable roll carrier luggage unit that can be used to transport bulky items safely and securely. The unit is a flat piece of material that is outfitted with end flaps and carrying straps and having a securing means such as hook and loop (e.g.: Velcro®) to secure an item rolled inside the carrier. The material is laid flat and the item to be carried, such as a tube, flat or rolled document, flat or rolled artwork, flat or rolled blueprints, flat or rolled nautical charts, clothing, food, or sport equipment is wrapped within the material and the securing means secures the rolled carrier. The roll carrier can be carried over the shoulder or by hand using convenient adjustable shoulder strap or handles. Support materials, e.g. foam core, wooded batten or dowel, can be inserted within the interior face of the material for additional rigidity and support during transport.

11 Claims, 9 Drawing Sheets

ROLL CARRIER

CROSS REFERENCE TO RELATED APPLICATIONS

This application claims priority under 35 U.S.C. Section 119 from U.S. patent application Ser. No. 60/187650 filed on Mar. 8, 2000, which is incorporated herein by reference for all purposes.

BACKGROUND OF THE INVENTION

1. Technical Field of the Invention

The present invention relates in general to a means of carrying items and is in the same family as luggage, portfolios, carrying tubes, briefcases, and carry-on cases. More specifically, the present invention relates to a flat piece of fabric that is outfitted with end-flaps and hook-and-loop closures, allowing it to be wrapped around a tube, document, artwork, map, charts or any item to be carried. The item to be carried can then be stored or transported in a soft-sided casing of the present invention for its easy transportation. The roll can be carried over the shoulder or by hand.

2. Background Art

Luggage is the broad term -used to describe the variety of shapes and sizes of containers used to transport goods. The contents of the luggage also vary in size, shape, value, and fragility. The common denominator is that carrying flat items is difficult, given the varying sizes and shapes.

Certain articles require specialized luggage. For example, the shape of art portfolios is generally sized to transport works that are long and high, but narrow in width. The carrying cases are designed to carry the general size and shape of art works, mostly prints (framed or unframed) that are transported in rectangular portfolios. The items are placed flat into the appropriately sized case and transported. Various attempts have been made to design a lightweight and convenient carrier that would accommodate items of varying dimensions. Once the works are inserted into the portfolios, they become very heavy and awkward, making the transportation onerous and more difficult.

Other types and configurations of art portfolios are common, including tube articles used to transport artwork or documents that are rolled. These are cylindrical soft-sided canisters with a zippered top cover. The diameter varies in size, but is typically four, six, eight, ten and twelve inches. They are generally three to six feet in length.

Golf bags are also cylindrical shaped bags, typically soft-sided, that carry expensive and heavy clubs. The popularity of the sport and the mobility of the players results in many golf clubs being transported across the United States and abroad. Due to the expensive of a golf club, the owners desire safe and convenient transportation mediums.

In order to address some of the difficulties of accommodating different sized pieces of artwork, plans, documents, etc., a roll carrier was developed. A roll carrier typically deploys a hollow cylinder of a particular size and shape: the items are rolled, placed into the carrier and transported.

The most commonly used carriers are cylindrical cases made of heavyweight metal, fiberboard, cardboard tubes, plastic, etc. The principal limitations of the roll carriers are that they are heavy, bulky, and can only accommodate adequately the size item for which they are designed. There is great variation in the sizes available, with diameters ranging in size from 3" to 12", and lengths varying greatly. These cases do not generally have convenient handles, they are not aesthetically pleasing, and are typically cumbersome to carry.

An example of a roll carrier is shown in U.S. Pat. No. 5,161,656 that shows a tubular shaped carrier that is attachable to a case. The tube has an opening for placing and removing rolled materials or objects capable of being placed inside the tube.

Various other forms of carriers have been developed, including the carrier of U.S. Pat. No. 4,210,244 for a tool carrier. A carrier base has a plurality of individual pockets designed or integrated into the carrier base for holding tools. The article is rolled and securely closed by interconnecting a handle section using hook and loop fasteners.

Another roll-up carrier is described in U.S. Pat. No. 5,758,811 which is a section of material affixed to a door panel on one side and has a coil spring to provide a rolled state of the material. The material can be unrolled and articles placed onto the material that is then rolled back up by the force of the spring.

An article carrier is also depicted in U.S. Pat. No. 5,800,001 wherein a substantially square section of material has slotted openings with accompanying carrying elements. The material is folded and fasteners secure the folded material and form a carrier with a handle.

What is needed is a lightweight piece of luggage that can adjust itself to accommodate the many different sized contents, allow easy access to the contents, protect the contents from the weather elements, and be easily carried. This device should be lightweight and provide compact storage when not in use. Finally, the luggage or carrier should be comfortable to carry, aesthetically fashionable and cost-effective.

SUMMARY OF THE INVENTION

The present invention has been made in consideration of the aforementioned background, and is a flat piece of fabric that is outfitted with end-flaps and hook-and-loop (e.g.: Velcro®) closures, allowing it to be wrapped around a tube, document, artwork, blueprint, chart, plan, etc. for its easy transportation. The roll can be carried over the shoulder or by hand using the convenient adjustable strap or hand handle.

An object of the invention is a roll carrier for securing and transporting one or more objects, comprising a substantially rectangular piece of plyable material having an exterior face and an interior face and with an upper edge, a bottom edge and a pair of side edges. One or more objects are rolled within the material, wherein the material is rolled starting from said bottom edge to form said roll carrier. There are end flaps with an interior face and an exterior face affixed on each of the side edges at the upper edge, wherein the interior face of the end flaps is attachable to the exterior face of the roll carrier. A width adjustment strap is located at a midsection between the side edges, wherein the width adjustment strap has a loose end portion extending from the upper edge and a fixed portion affixed lengthwise along the exterior surface of the material, and wherein the loose end portion has a means of securing to the fixed portion of the roll carrier. Furthermore, there is a carrying strap attached to the exterior face of the material.

Another object is a roll carrier wherein the carrying strap is an adjustable shoulder strap. Also, wherein the carrying strap is a hand strap.

A further object is a roll carrier further comprising a plurality of strips of loop material affixed lengthwise on the exterior surface of the material and parallel to and in close proximity to the side edges and wherein the interior face of the end flaps has a section of hook material that engages the strips of loop material.

An object includes a roll carrier further comprising a support casing in the material for inserting a support material.

Additionally, the roll carrier, further comprising a pair of security tabs extending from the upper edge of the material in close proximity to the side edges wherein the security tabs have a means of securing to the exterior face of the material.

Also, the roll carrier wherein the means of securing is selected from the group consisting of hook and loop, snaps, rivets, buckles, zippers, tie straps, buttons, clasps and fasteners.

An object of the invention is a roll carrier for securing and transporting one or more objects, comprising a substantially rectangular piece of plyable material having an exterior face and an interior face and with an upper edge, a bottom edge and a pair of side edges, wherein the objects are rolled within the material and the material is rolled starting from the bottom edge to form the roll carrier. There are a pair of end flaps with an interior face and an exterior face interconnected on each of the side edges and at the upper edge, wherein the interior face of the end flaps has hook material and is attachable to a plurality of strips of loop material affixed lengthwise on the exterior surface of the material and parallel to and in close proximity to the side edges, and the interior face of the end flaps engages the strips of the loop material. A width adjustment strap is located at a midsection between the side edges, wherein the width adjustment strap has a loose end hook portion extending from the upper edge and a fixed loop portion affixed lengthwise along the exterior surface of the material, and wherein the loose end hook portion engages the fixed loop portion of the roll carrier. A carrying strap is attached to the exterior face of the material.

And, a further object is the roll carrier comprising a plurality of security tabs of hook material extending from the upper edge and located in order to engage the strips of loop material.

Another object is the roll carrier further comprising a support casing in the material for inserting a support material.

Additionally, the roll carrier wherein the carrying strap is an adjustable shoulder strap and further comprising a hand strap affixed to the exterior face of the material and located at a midpoint between the adjustable shoulder strap and beneath the adjustable shoulder strap.

Another object is an apparatus that is compact and stores easily in other luggage or even in a drawer when not in use. The luggage is made of durable fabric that comes in a wide variety of colors and also can be affixed with designs and logos.

A further object is to provide a roll carrier that is adjustable so that large and small articles can be conveniently and safely transported by adjusting the straps of the unit and the end flaps.

Another object is to be able to carry the roll carrier over the shoulder so that hands are free.

And another object is to provide a roll carrier golf bag for a limited number of clubs so they are safe during transport.

Further uses for this fabric object are to be able to utilize it to carry many types of items in sports, e.g. scooters, kites, bow and arrows, fishing rods, bat and accessories, and in other areas such as clothing or beach wear or even food.

Still other objects and advantages of the present invention will become readily apparent to those skilled in this art from the following detailed description, wherein I have shown and described only a preferred embodiment of the invention, simply by way of illustration of the best mode contemplated by me on carrying out my invention. As will be realized, the invention is capable of other and different embodiments, and its several details are capable of modifications in various obvious respects, all without departing from the invention.

BRIEF DESCRIPTION OF THE DRAWINGS

The present invention will be readily understood by the following detailed description in conjunction with the accompanying drawings, wherein like reference numerals designate like structural elements, and in which.

DESCRIPTION OF THE PREFERRED EMBODIMENT

Figure 1:
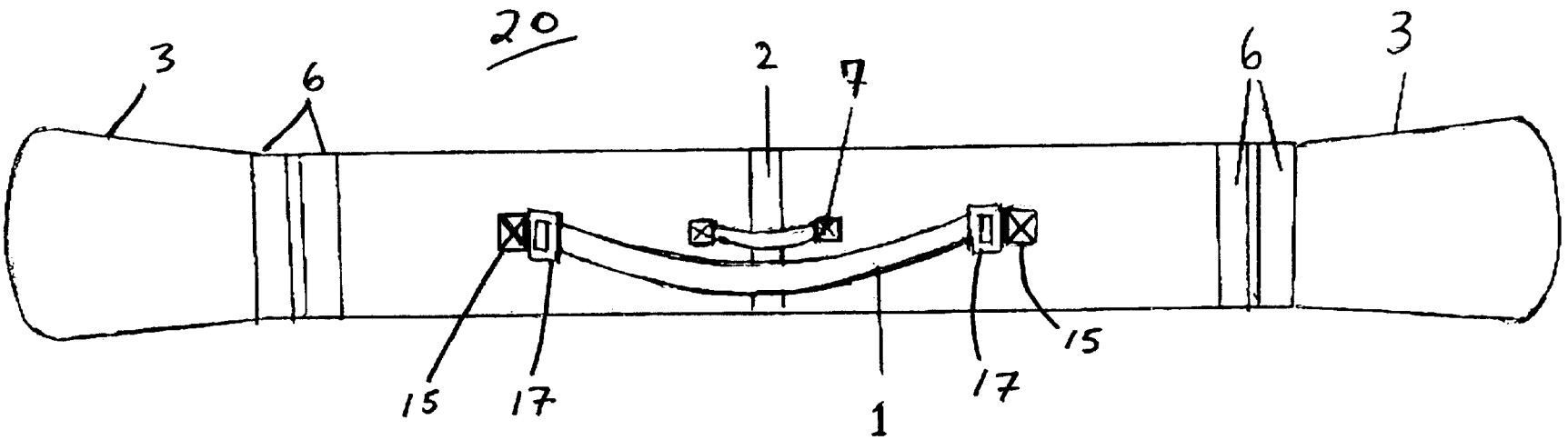
FIG. 1 is a top perspective view of the carrier rolled and with flaps extended illustrating the attached adjustable carrier strap FIG. 2 a back view, rolled, with flaps extended FIG. 3 a side view roll carrier, rolled and with flaps folded FIG. 4 an open and flattened roll carrier, outside view FIG. 5 an unrolled roll carrier, inside view FIG. 6 detailed depiction of the inside of the end flap

A first embodiment of the roll carrier of the present invention described as a luggage article, is described in detail herein. In FIG. 1 a top view exterior perspective of the roll carrier 20, rolled and with end flaps 3 extended, shows the attached adjustable carrier strap 1. The strap 1 is adjustable and it allows the user to carry the roll 20 by hand or over the shoulder. The strap 1 can be padded for additional comfort. The strap 1 is adjustable to accommodate the size/shape of the article as well as the person carrying the roll 20. In the preferred embodiment, buckles 17 are used as the adjusting means for the shoulder strap 1. In a preferred embodiment the shoulder strap 1 is permanently affixed to the article 20 by stitching 15, although it is within the scope of the invention to secure connectors to the article 20 and have a removable shoulder strap 1 that attaches to the connectors.

The hand strap or handle 7 is also shown. In this embodiment, it is permanently attached and sewn in place equidistant from each end flap 3 and between and under the shoulder strap 1. The hand handle 7 can be padded and allows the user to carry the roll carrier 20 by hand. In this embodiment the hand handle 7 is permanently affixed by stitching at the ends, however it is within the scope of the invention to have connectors affixed to the article 20 and the hand handle 7 removably attached to the connectors.

The securing means of the width adjustment strap 2 is hook and loop in a preferred embodiment. The closure is secured using hook and loop, wherein the gripping means is on the loose end and the receiving end is affixed to the roll 20. The gripping means is typically rows of small plastic hooking structures commonly referred to as hook that adhere to the woven surface called loop of the receiving end.

Figure 4:
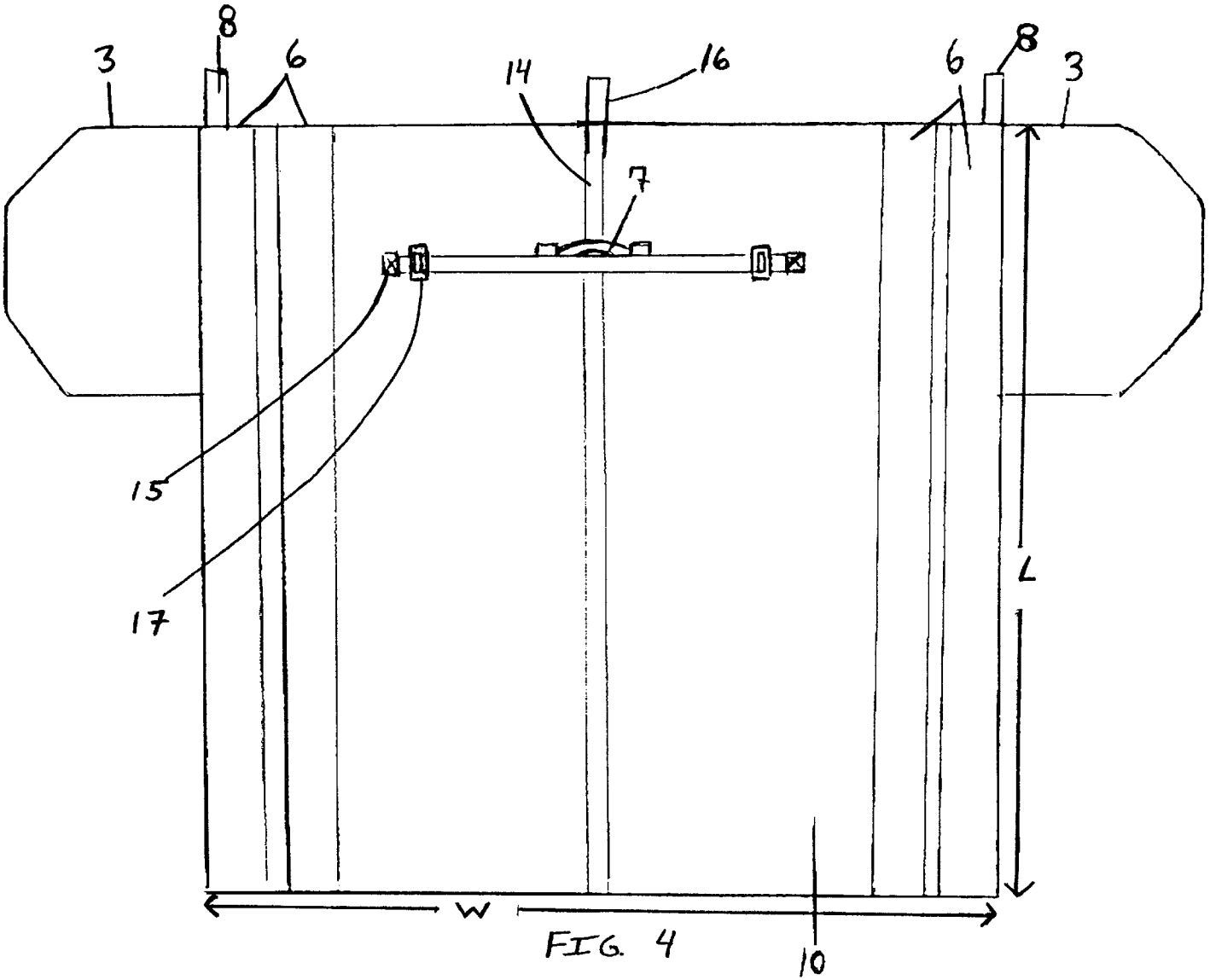

As further illustrated in FIG. 4, the width adjustment strap 2 comprises a single strip of loop material 14 fixedly attached to the length of the roll 20 with a loose end of hook material 16 that secures to the fixed loop portion 14 after the carrier 20 is rolled. In one embodiment the loose end 16 extends approximately six inches beyond the upper edge of the unfolded carrier 20. The hook and loop is affixed to the roll 20 by stitching in the preferred embodiment, although other securing means are within the scope of the invention such as adhesives and rivets.

While hook and loop is used in the preferred embodiment for the width adjustment strap 2, other securing means are possible. For example, buckles with straps, buttons, snaps, hook and clasps, and tie strings are other possible means of closing the width adjustment strap 2. Once the item to be carried is wrapped within the carrier 20, the loose end 16 of the width adjustment strap 2 is pulled taut and secured to the fixed length of the loop material 14.

While hook and loop securing is a preferred means, other means of securing include snaps, rivets, buckles, zippers, tie cords, buttons, clasps and fasteners.

Referring again to FIG. 1, the fold-down end flap 3 is attached at the right and left sides. The exterior surface is shown, and made of the same material as the substantially rectangular material that makes up the roll carrier 20. FIGS. 5, 6, 7, and 8 illustrate the end flap 3 in more detail, wherein the end flap 3 has an inner face and an exposed face.

End strips of loop material 6 are placed along the side edge of the carrier 20 running the length of the carrier 20. The end strips of loop material 6 mesh with the interior face hook portions 4 of the interior end flap 3 to securely close the roll carrier 20 ends at the desired dimensions. This secures the end flaps 3 in place and accommodates items of varying sizes with a single roll carrier 20. The overall dimensions of the roll carrier 20 vary depending upon the size of the carrier as well as the adjustments made to the carrier. One of the significant market advantages of the carrier 20 is the flexibility of the device and the ability to accommodate articles of differing sizes and shapes.

The end strips 6 are shown as strips of approximately one inch in width and spaced apart at approximately one inch intervals. The strips 6 are arranged in a parallel manner close to the side edges. A plurality of strips provides flexibility in securing the end flaps depending upon the dimensions of the items being carried. There is no requirement that the end strips be a particular size, and other widths are within the scope of the invention, including having a single strip of wider width.

Figure 2:
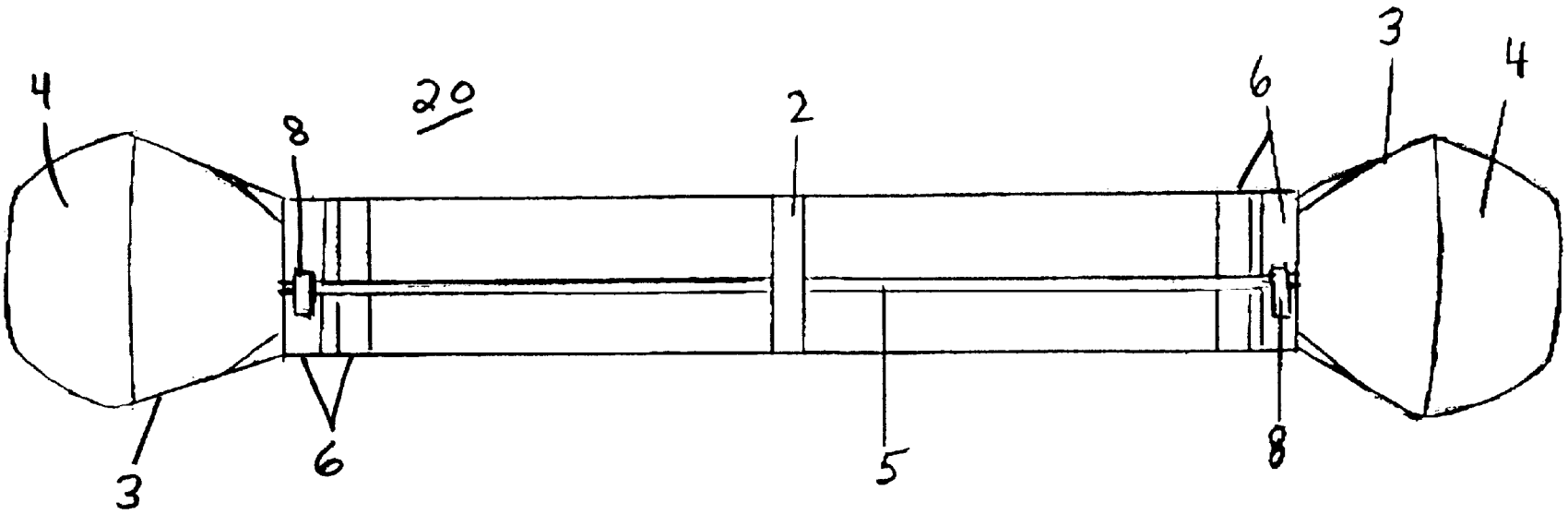

In FIG. 2, a back view of the rolled article 20 with flaps extended, showing the overlapping seam edge 5 that allows the carrier to adjust itself to different sized contents, while fully enclosing and protecting the contents. The seam edge 5 represents the junction after the item is wrapped within the roll article 20. It is the upper edge of the material shown in FIG. 4 oriented after rolling.

This interior view of the end flaps 3 shows a section of hook material 4 attached to the outer portion that engages the strips of loop material 6 when the end flap 3 is folded over and closed. Two security tabs 8 with hook material are fastened at each end of the loop material 6 to allow tighter closure before the end flaps 3 are folded closed. The security tabs are shown in more detail in FIG. 4.

Figure 3:
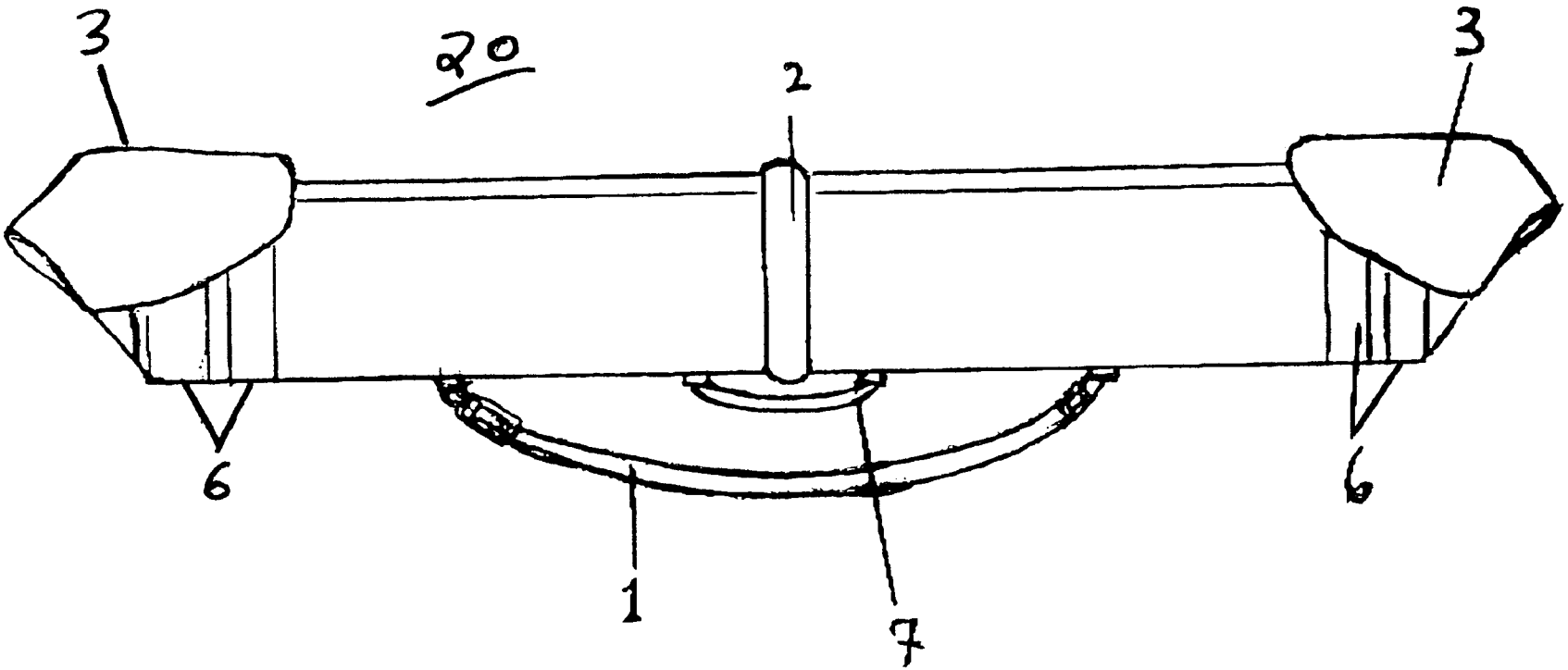

In FIG. 3, a side view of the roll carrier 20 is illustrated with the carrier rolled and with end flaps 3 folded. This orientation shows the positions of the attached adjustable carrier strap 1, hand handle 7, and the hook and loop of the width adjustment strap 2. As shown, the end flap interior section with the hooks section 4 engages the end sections of loop material 6, leaving the exterior surface of the end flaps 3 exposed. The end sections of loop material 6 are spaced at convenient intervals so that the end flap 3 can be secured to any of the end sections 6 and secure the item to be carried.

In FIG. 4, an open and flattened exterior face of the roll carrier 20 shows the substantially rectangular material 10 with the end flaps 3. It also shows the placement of the adjustable carrier strap 1, the hand handle 7, the fixed loop portion 14 and the loose end 16 of the width adjustment strap 2, the end flaps 3, the end loop strips 6 with security tabs 8 on the outside of the flat piece of material 10. The end loop strips 6 are fixedly attached by stitching while the security tab 8 of hook material extending approximately two inches beyond the upper edge is affixed by stitching or adhesive.

In one embodiment the total width 'W' of the roll carrier 20 varies between 30 and 40 inches, the length 'L' varies from 30 to 40 inches, and the end flaps 3 extend nine inches from the side edges. With these dimensions the roll carrier can cover pieces from three to nine inches in diameter and up to 40 inches in length.

The material 10 of the preferred embodiment is washable and can be folded in a compact configuration when not in use. A preferred material is 1000 denier Cordura nylon or similar material. This material is durable, puncture proof, washable, and water-resistant.

Figure 5:
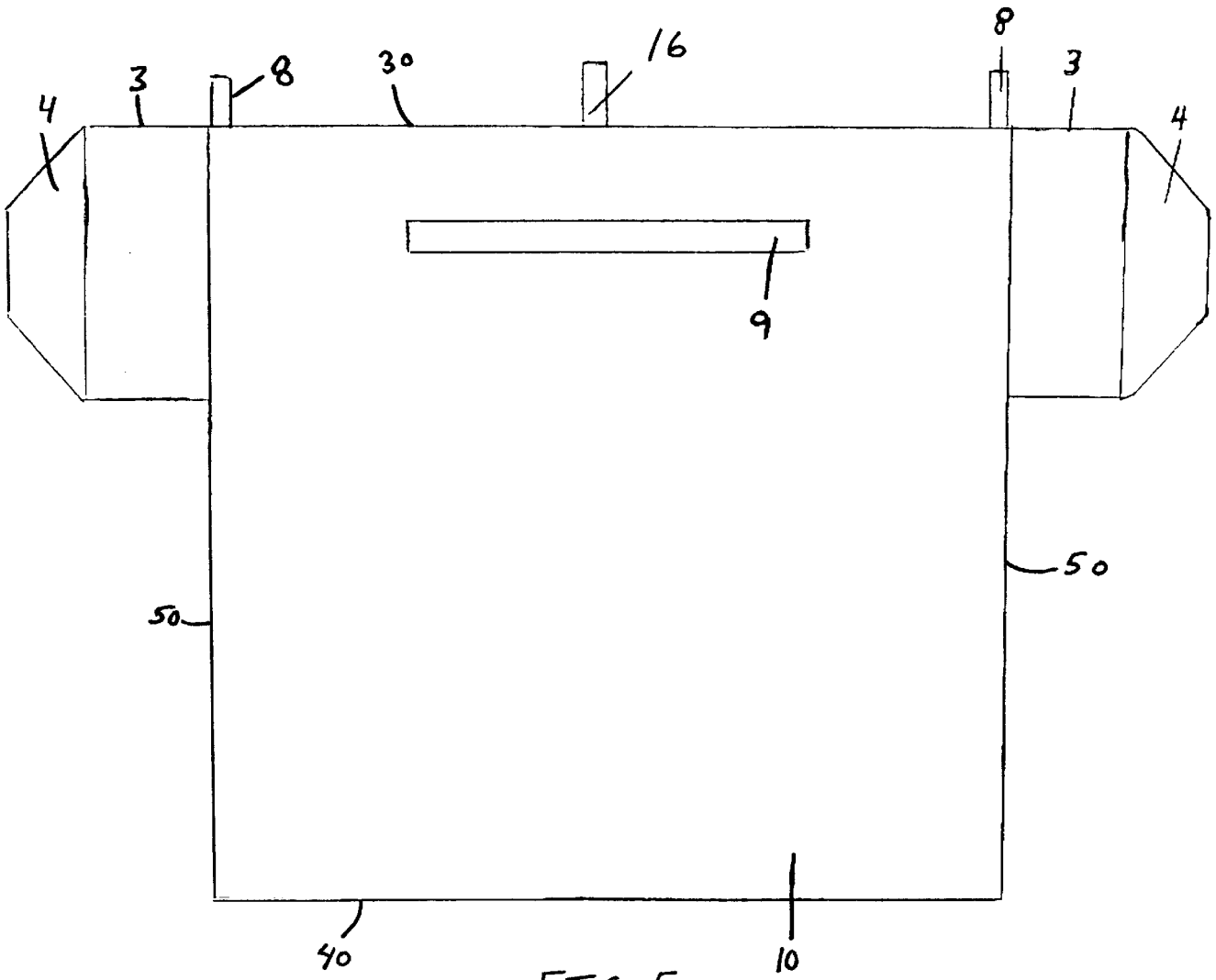

FIG. 5 shows the interior face of the unrolled roll carrier 20. It shows the placement of the hook portion 4 on the interior of the end flap 3 as well as the loose end 16 and security tabs 8 in relation to the plyable material 10. FIG. 5 also illustrates the orientation of the upper edge 30 the lower edge 40 and the side edges 50.

An internal support casing 9 is sewn to the interior of the material 10 to contain a piece of support material, for example, foam core, wooden batten, cardboard or dowel. The internal support casing 9 is essentially an access hole for the support material. Although a support material is not required, there are certain articles that may require additional support to prevent damage or bending during transport. For example, placing a wooden batten approximately one inch wide, ¼ inch in width and at a length sufficient to fit within the length of the material 10 and still allow easy placement provides some rigidity to the overall carrier. The support material can also be rolled along with the item to be transported instead of using the internal support casing.

Figure 6:
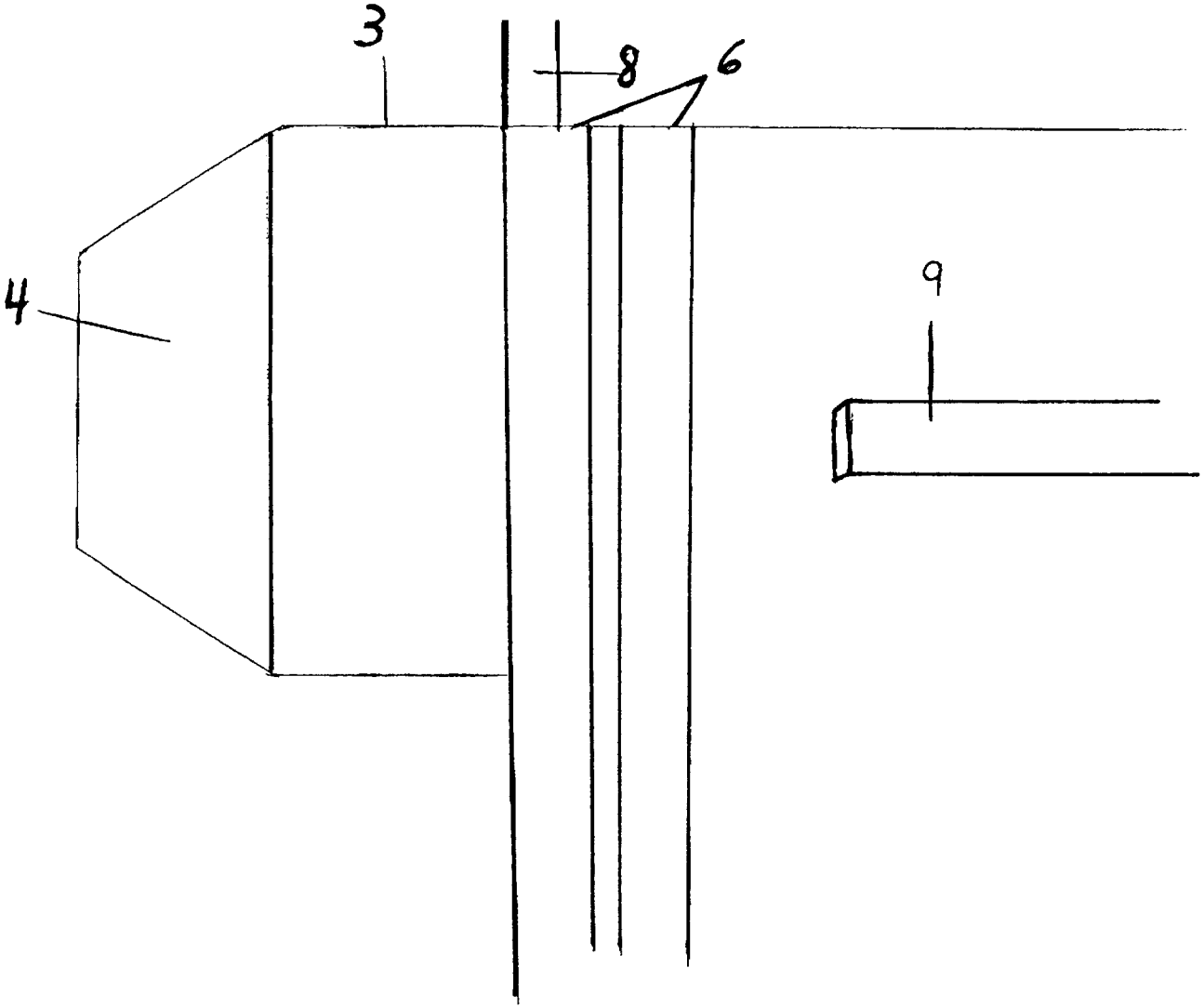

FIG. 6 is a detailed depiction of the interior of the end flap 3, showing the placement of the hook portion 4. The orientation of the security straps 8 and internal support casing 9 are also shown.

Figure 7:
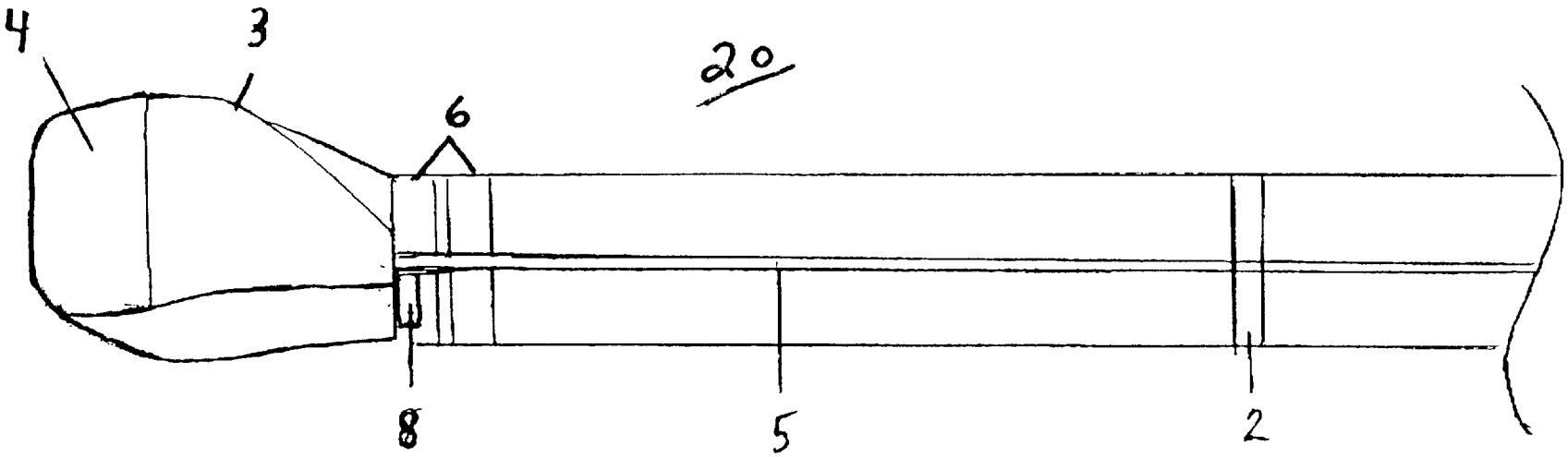
FIG. 7 illustrates a rolled up and partially secured roll carrier
Figure 8:
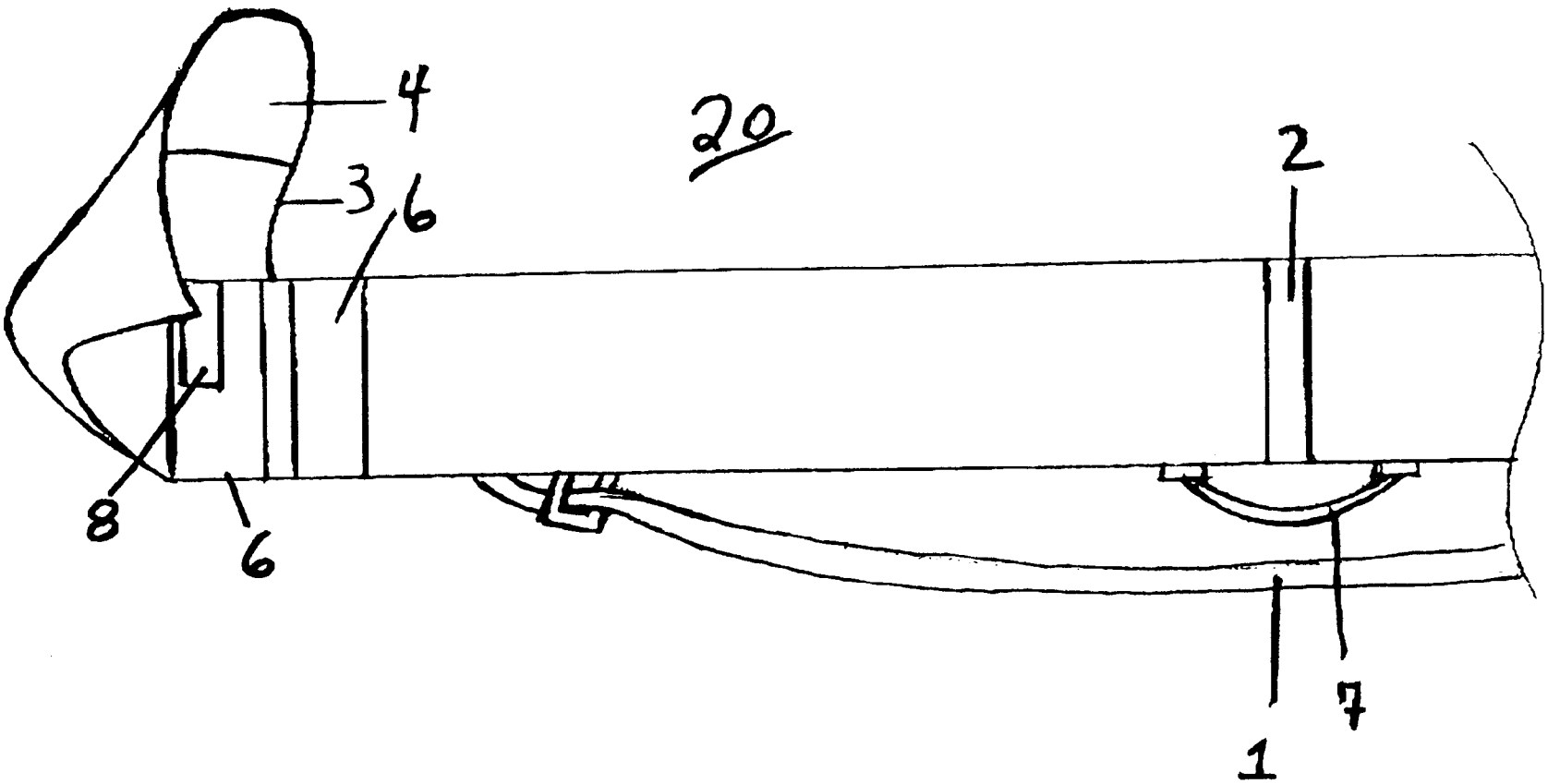
FIG. 8 illustrates a rolled up and partially secured roll carrier FIG. 9 step-by-step diagrammatic display of operation for the roll carrier

FIG. 7 and FIG. 8 illustrate a rolled up and partially secured roll carrier and detail how the end flap 3 is folded and secured to one of the end loop strips 6. The end flap 3 acts like a hand and curves around the tubular shaped rolled carrier 20 and fastens to the end loop strips 6. In operation, the roll carrier is laid flat, interior surface facing up (see FIG. 5). The items to be transported are positioned on the interior surface of the material 10 at the bottom edge. The item is then rolled within the material 10 to form a rolled bundle. The loose end of the width adjustment strap 2 attaches to the receiving portion of the strap. The security tabs 8 are fastened to loop portion 6 affixed to the roll, securing the contents inside. The end flap 3 is folded so that hook portion 4 adheres to loop portion 6, covering the security tabs 8. The end flap 3 is shaped in such a way that its sides fold neatly in on itself, eliminating any bulkiness. The entire end flap 3 is then folded over and fastened so that hook portion 4 adheres to loop portion 6.

Figure 9:
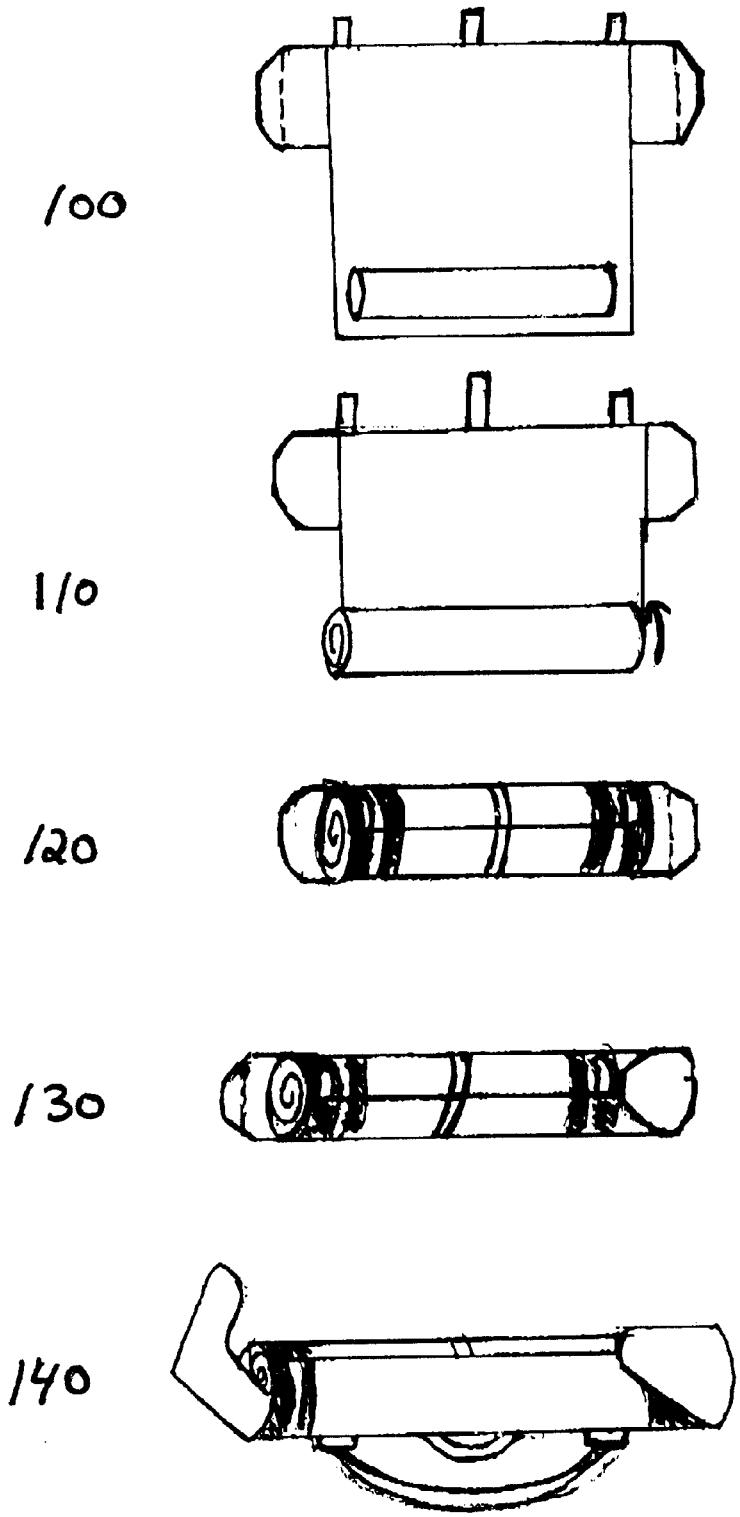

FIG. 9 depicts this process by a detailed step-by-step pictorial flow chart for rolling an item and securing the item within the roll carrier 20. The first step 100 is to place the item to be carried onto the interior face of the material.

The item is then rolled up as shown in step 110 so that the item is wrapped in secured within the rolled layers. Once the rolling process 110 is completed, the next step 120 shows the loose end engages the loop portion of the width adjustment strap and the security tabs on both ends engage the loop sections.

Next, 130, 140 the end flaps are folded over on both sides so that the interior hook portion of the end flaps adheres to the loop strips and cover the security tabs. Once both end flaps are secured, the item is ready for transport.

While a cylindrical item is displayed in this embodiment, the size and shape of the article is not a limitation or restriction. While the physical dimensions of the item must be within the limitations of the material length and width, the roll carrier of the present invention can be used for any reasonably dimensioned item.

The foregoing description of the preferred embodiment of the invention has been presented for the purpose of illustration and description. It is not intended to be exhaustive or to limit the invention to the precise form disclosed. Many modifications and variations are possible in light of the above writings. It is intended that the scope of the invention be limited not by this detailed description, but rather by the claims appended hereto.

The invention is susceptible of many variations, all within the scope of the specification, figures, and claims. The preferred embodiment described here and illustrated in the figures should not be construed as in any way limiting.

What is claimed is:

1. A roll carrier for securing and transporting one or more objects, comprising:

a substantially rectangular piece of plyable material having an exterior face and all interior face and with an upper edge, a bottom edge and a pair of side edges, wherein one or mote objects are rolled within said material, wherein said material is rolled starting from said bottom edge to form said roll carrier;

a pair of plyable end flaps each with an interior face and an exterior face, wherein each of said plyable end flaps is affixed on each of said side edges at said upper edge, and wherein said interior face of said end flaps is attachable to said exterior face of said roll carrier when said end flaps are folded;

a width adjustment strap located at a midsection between said side edges, wherein said width adjustment strap has a loose end portion extending from said upper edge and a fixed portion affixed lengthwise along said exterior surface of said material, and wherein said loose end portion has a means for securing to said fixed portion of said roll carrier; and a carrying strap attached to said exterior face of said material.

2. The roll carrier according to claim 1, wherein said carrying strap is an adjustable shoulder strap.

3. The roll carrier according to claim 1, wherein said carrying strap is a hand strap.

4. The roll carrier according to claim 1, further comprising a plurality of strips of loop material affixed lengthwise on said exterior surface of said material and parallel to and in close proximity to said side edges and wherein said interior face of said end flaps has a section of hook material that engages said strips of loop material.

5. The roll carrier according to claim 1, further comprising a support casing in said material for inserting a support material.

6. The roll carrier according to claim 1, further comprising a pair of security tabs extending from said upper edge of said material in close proximity to said side edges wherein said security tabs have a means of securing to said exterior face of said material.

7. The roll carrier according to claim 1, wherein said means of securing is selected from the group consisting of hook and loop, snaps, rivets, buckles, zippers, tie straps, buttons, clasps and fasteners.

8. A roll carrier for securing and transporting one or more objects, comprising:

a substantially rectangular piece of plyable material having an exterior face and an interior face and with an upper edge, a bottom edge and a pair of side edges, wherein one or more objects are rolled within said material, wherein said material is rolled starting from said bottom edge to form said roll carrier;

a pair of end flaps with an interior face and an exterior face interconnected on each of said side edges at said upper edge, wherein said interior face of said end flaps has hook material and is attachable to a plurality of strips of loop material affixed lengthwise on said exterior surface of said material and parallel to and in close proximity to said side edges and wherein said interior face of said end flaps engages said strips of loop material;

a width adjustment strap located at a midsection between said side edges, wherein said width adjustment strap has a loose end hook portion extending from said upper edge and a fixed loop portion affixed lengthwise along said exterior surface of said material, and wherein said loose end hook portion engages said fixed loop portion of said roll carrier; and a carrying strap attached to said exterior face of said material.

9. The roll carrier according to claim 8, further comprising a plurality of security tabs of hook material extending from said upper edge and located to engage said strips of loop material.

10. The roll carrier according to claim 8, further comprising a support casing in said material for inserting a support material.

11. The roll carrier according to claim 8, wherein said carrying strap is an adjustable shoulder strap and further comprising a hand strap affixed to said exterior face of said material and located at a midpoint between said adjustable shoulder strap and beneath said adjustable shoulder strap.

* * * * *

UNITED STATES PATENT AND TRADEMARK OFFICE

CERTIFICATE OF CORRECTION

PATENT NO. : 6,513,692 B1
DATED : February 4, 2003
INVENTOR(S) : Lee Forgosh and Joanne Taube It is certified that error appears in the above-identified patent and that said Letters Patent is hereby corrected as shown below:

Title page,
Item [56], References Cited, U.S. PATENT DOCUMENTS, insert
-- 4,210,244 7/1980 Westrick
4,654,907 4/1987 Haugaard
5,161,656 11/1992 Brenner
5,758,811 6/1998 Aumiller et al.
5,800,001 9/1998 Anastasi
6,189,689 B1 2/2001 Toussaint --

Column 7,
Line 38, delete “mote”, insert -- more --

Signed and Sealed this

Fourteenth Day of September, 2004

JON W. DUDAS
*Director of the United States Patent and Trademark Office*